US009288566B2

(12) United States Patent
Minarik et al.

(10) Patent No.: US 9,288,566 B2
(45) Date of Patent: Mar. 15, 2016

(54) HEADPHONES WITH CORD MANAGEMENT SYSTEM

(71) Applicant: DEI Headquarters, Inc., Vista, CA (US)

(72) Inventors: Ryan Minarik, Oceanside, CA (US); Michael DiTullo, Encinitas, CA (US)

(73) Assignee: DEI Headquarters, Inc.

( * ) Notice: Subject to any disclaimer, the term of this patent is extended or adjusted under 35 U.S.C. 154(b) by 45 days.

(21) Appl. No.: 14/106,668

(22) Filed: Dec. 13, 2013

(65) Prior Publication Data

US 2014/0169611 A1 Jun. 19, 2014

Related U.S. Application Data

(60) Provisional application No. 61/736,802, filed on Dec. 13, 2012.

(51) Int. Cl.
*H04R 1/10* (2006.01)
*H04R 5/033* (2006.01)

(52) U.S. Cl.
CPC ..... *H04R 1/1033* (2013.01); *H04R 1/1016* (2013.01); *H04R 5/033* (2013.01)

(58) Field of Classification Search
USPC ..... 381/370–371, 374–375, 379–381, 381/383–384
See application file for complete search history.

(56) References Cited

U.S. PATENT DOCUMENTS

| | | | | |
|---|---|---|---|---|
| 6,374,126 | B1 * | 4/2002 | MacDonald et al. | 381/374 |
| 7,436,974 | B2 * | 10/2008 | Harper | 381/374 |
| 7,693,295 | B2 * | 4/2010 | Harper | 381/374 |
| 8,189,843 | B2 * | 5/2012 | Harper | 381/374 |
| 8,249,286 | B2 * | 8/2012 | Nault | 381/380 |
| 8,891,798 | B1 * | 11/2014 | Laffon de Mazieres et al. | 381/374 |
| 2008/0317274 | A1 * | 12/2008 | Kim | 381/370 |

* cited by examiner

*Primary Examiner* — Suhan Ni
(74) *Attorney, Agent, or Firm* — KC Bean, Esq.

(57) ABSTRACT

An in-ear headphone system with cord management system. The system provide for conjugation of each headphone to provide a spool for winding and securing the cord about the spool.

8 Claims, 5 Drawing Sheets

HEADPHONES WITH CORD MANAGEMENT SYSTEM

CROSS-REFERENCE TO RELATED APPLICATIONS

This application claims the benefit of and is a continuation of U.S. Provisional Patent Application Ser. No. 61/736,802 filed Dec. 13, 2012 and entitled HEADPHONES WITH CORD MANAGEMENT SYSTEM

BACKGROUND OF THE INVENTION

The present invention is in the field of in-ear audio headphones having a cord management system.

Audio headphones have long been a staple for audiophiles for use in applications where the quality of the listener's audio experience was crucial. With active lifestyles and the introduction of digital audio players and smart phones the use of in-ear audio headphones have continued to grow significantly. Audio headphones receives audio signals from an audio source player. The source player transmits the signal to the headphones through an audio cord. For in-ear headphone applications, the cord generally is a shielded plastic or rubberized stereo cord that is thin and flexible with an electrical connector or jack at the terminal end for making electrical connection with the source player. The cord must be of a sufficient length to allow the headphones to reach the listeners ears while maintaining the source at a stable location such as in the users pocket or clipped to the user's belt.

The length of the cord often creates problems for the listener when the headphones are not in use. When putting the headphones in a user's pocket or setting the headphones aside the cord can become unintentionally bunched, wound, tangled, coiled or wrapped around other items. The cord often times become tangled and twisted or get snagged, causing annoyance and potentially damaging the cord.

There have been some attempts at developing cord management systems for in-ear headphones. Generally, these cord management techniques are ineffective and in many instances exacerbate tangling. Some require wrapping or coiling the cord around a core object, like a spool and thread. A key limitation with this type of system is that a part separate from the headphones is required to be used as the core, and that object can be easily separated from the headphones and lost. If the object is somehow attached to the headphone cord it will dangle and sway, causing annoyance when listening, especially when listening during an activity such as jogging.

Some have used a zipper concept to zip the cord. This method creates significant additional cost in manufacturing and the space required for cord is significantly greater than standard cords. Therefore, there is a need for a convenient effective headphone cord management system that prevents the cord from tangling has a small space requirements and is convenient for users.

BRIEF SUMMARY OF THE INVENTION

The disclosed embodiment of the current invention relates to an audio headphone cord management system and method that provides easy management of in-ear headphone cords. The objects of this invention is to provide novel solutions to overcome the limitation described relating to current in-ear audio headphone cord management systems.

One object of the present invention is to provide an in-ear audio headphone cord management system that allows a user to uniquely join each ear piece to form a spool.

Another object of the invention is to provide an in-ear audio headphone cord management system where the system does not require a separate spool for wrapping the headphone cord.

It is yet another object of the invention to provide a method of customizing audio headphones to suit a listeners fashion and audio quality preferences.

Additional features and advantages of exemplary implementations of the invention will be set forth in the following description, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWING

In order to describe the manner in which the above-recited and other advantages and features of the invention can be obtained, a more particular description of the invention briefly described above will be rendered by reference to the specific embodiment that is illustrated in the appended drawings. Understanding that these drawings depict only a typical embodiment of the invention and are not therefore to be considered to be limiting of its scope, the invention will be described and explained with additional specificity and detail through the use of the accompanying drawings in which.

DESCRIPTION OF THE INVENTION

Figure 1:
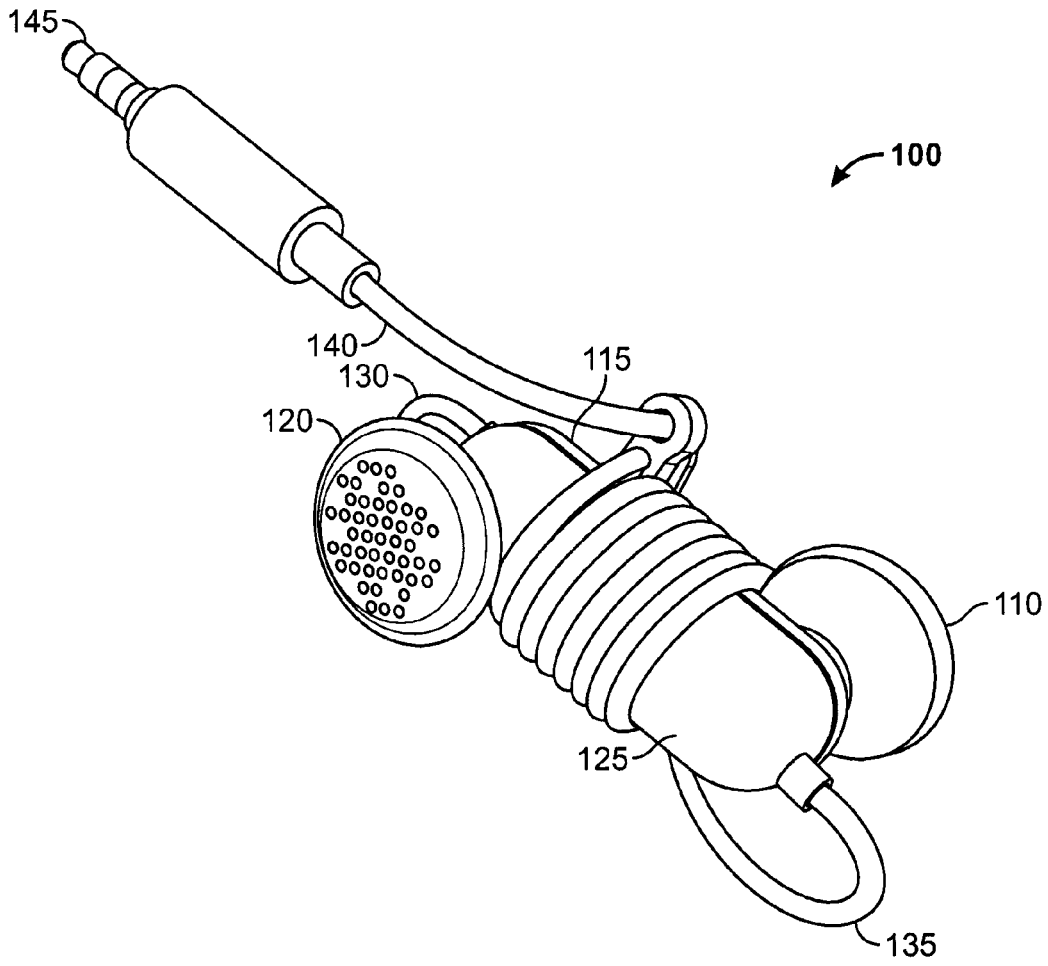
FIG. 1 is a perspective view of one embodiment of the headphone system of the current invention.

Example embodiments are described herein in the context of an in-ear headphone system with cord management. Those of ordinary skill in the art will realize that the following description is illustrative only and is not intended to be in any way limiting. Other embodiments will readily suggest themselves to such skilled persons having the benefit of this disclosure. Reference will now be made in detail to implementations of the example embodiment as illustrated in the accompanying drawings. The same reference indicators will be used throughout the drawings and the following description to refer to the same or like items.

Now with reference to FIGS. 1, 2A, 2B, and 2C, the present invention is an in-ear headphone system having an integrated cord management system 100. The system 100 has first ear bud 110 and a second ear bud 120 which can be fitted into the ears of a listener. Each ear bud 100, 110 is fixed to the distal end 112 of column shaped bases 115 and 125, each having a cord 130 and 135 extending from the proximal end 114 of each base 115 and 125 respectively. The ends of each cord 130 and 135 extend from proximal end of the first and second base 115 and 125 respectively and merge into a single cord 140 having a jack 145 at the distal end of the merged cord 140. The Jack 140 is inserted into an audio player and provides an electrical connection to speaker drivers (not shown) within each ear bud 110 and 120.

Figure 2A:
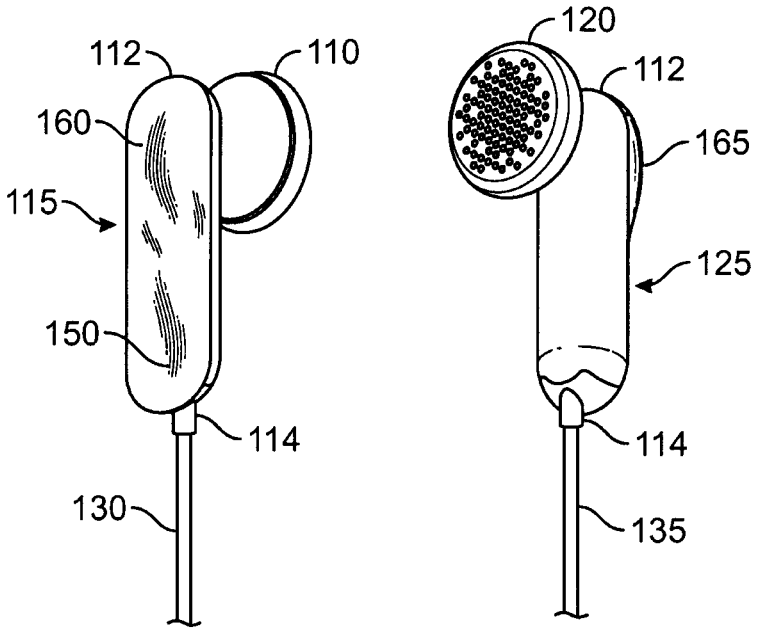
FIG. 2A is a perspective view of one embodiment of the headphone system of the current invention with ear buds inward facing.
Figure 2B:
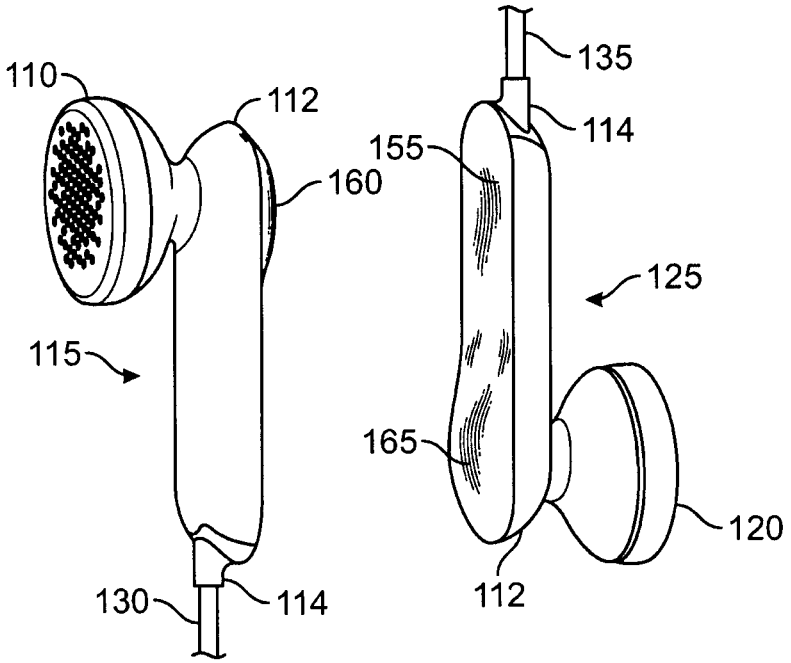
FIG. 2B is a perspective view of one embodiment of the headphone system of the current invention with ear buds outward facing.
Figure 2C:
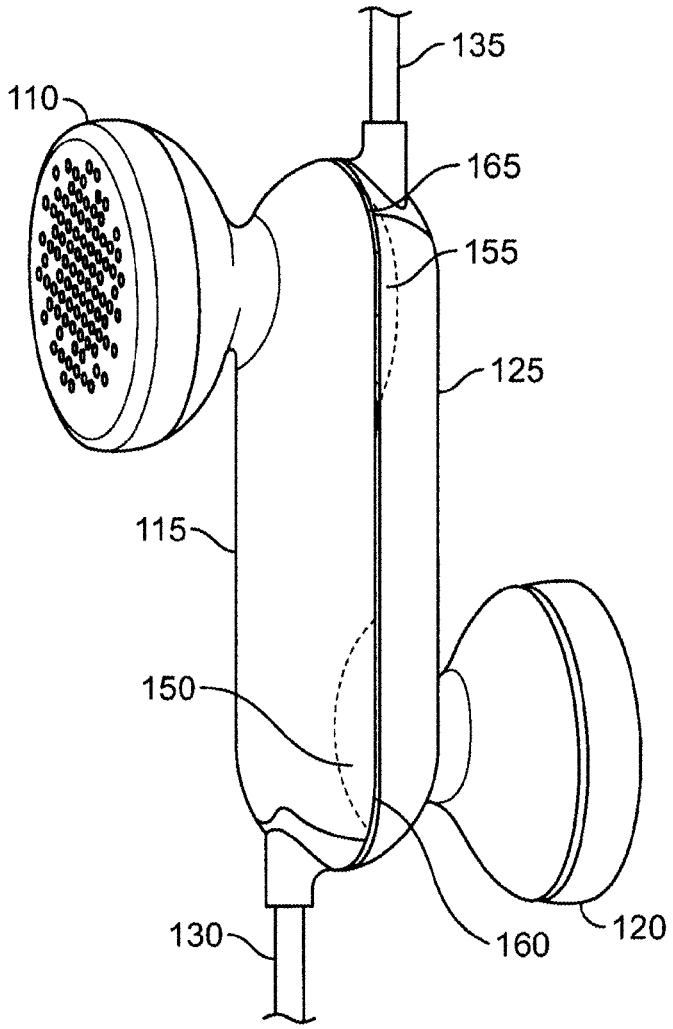
FIG. 2C is a perspective view of one embodiment of the headphone system of the current invention with each ear piece mated to form a spool.

Each base 115 and 125 includes a means for releasably fixing the first base 115 to the second base 125. With reference to FIGS. 2A, 2B and 2C, in the disclosed embodiment, the means for fixing the first base 115 to the second base 125 is a strong magnet (not shown) attached to or incorporated into the construction of each base. The magnet is preferably a neodymium magnet, which provides of strong magnetic force with a small amount of magnetic material. The first base 115 and the second base 125 each have a concave portion 150 and 155 respectively toward the proximal end of each base and a convex portion 160 and 165 toward the distal end of each base 115 125 respectively.

Figure 3:
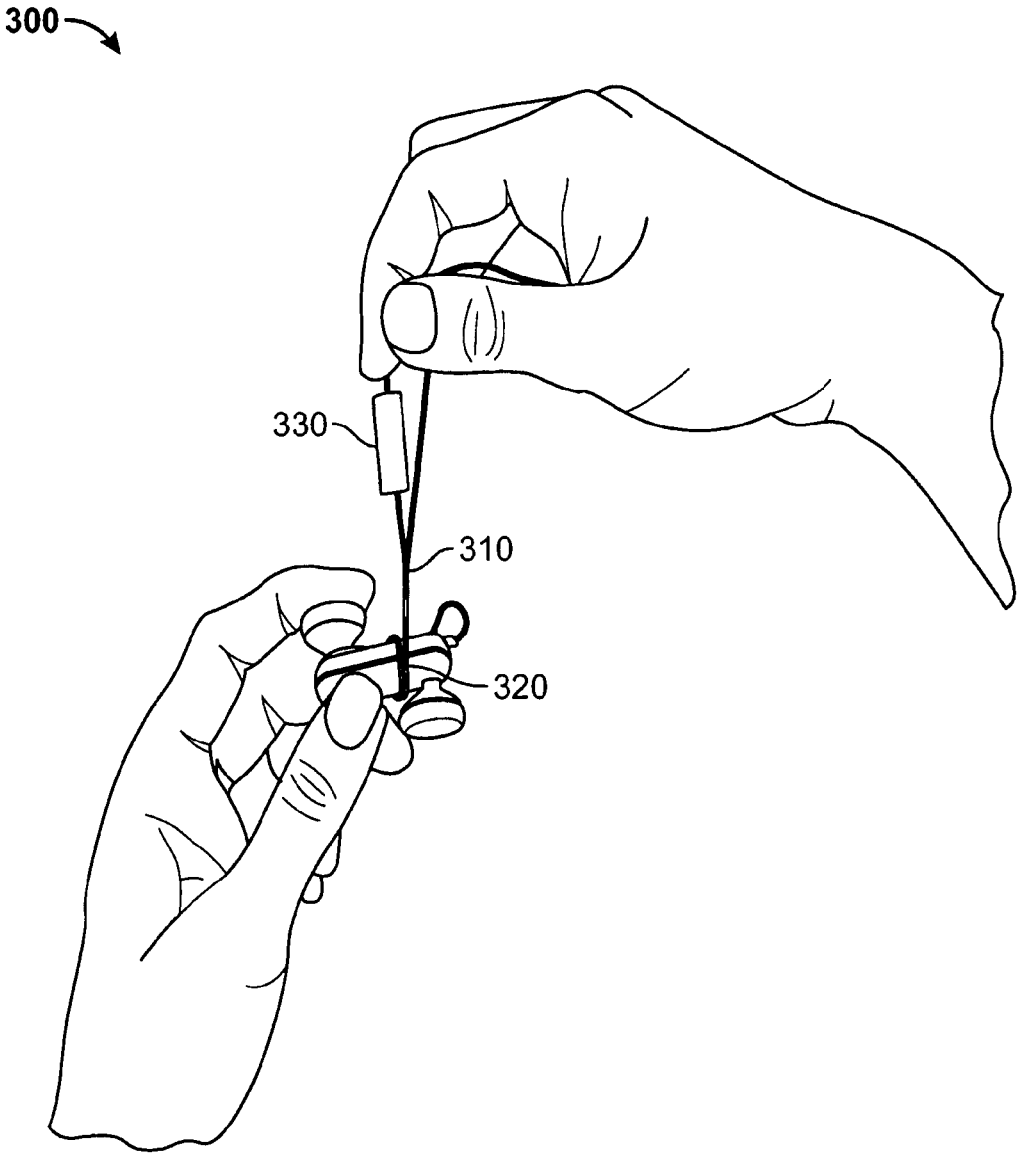
FIG. 3 is a perspective view of one embodiment of the headphone system of the current invention showing the headphone cord wound about ear pieces formed as a spool.

As shown in FIG. 2C, the concave portions 150 155 and the convex portions 160 165 of each headphone base 115 and 125, when the bases are positioned inversely to each other, they are configured so that the convex portions 160 and 165 naturally nest with the concave portions 150 and 155, causing the two separate bases to become one solid column as demonstrated in FIG. 3; the bases being secured together by the strong magnet. As shown in FIG. 3, once the headphone bases are magnetically held together and nested 300, the combined bodies of the bases 320 become a spool for coiling the headphone cord 310. The cord then can wrap around the body of the joined bases. The cord 310 may also contain a control device 330 to control the volume and audio file of the source.

Figure 4:
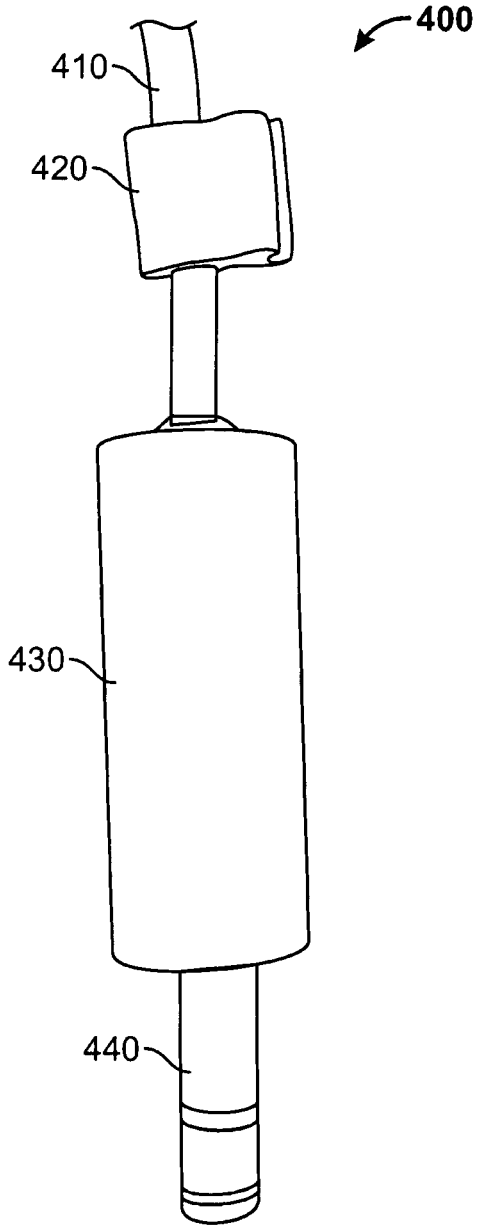
FIG. 4 is a profile view of one embodiment of the headphone system of the current invention showing the headphone cord clip near the audio jack.

Now referring to FIG. 4, shown is the terminal end of the cord 400. At the end of the cord 410 is the audio jack 440, with a jack connector 430. Near the jack connector 430 is a cord fastener 420. Once the cord 410 is wrapped around the spool created by securing the two ear pieces, the user can use a cord fastener 420 integrated into the cord to clasp the cord 410 in the coiled position as show in FIG. 1. When the listener again wishes to use the headphone it is only necessary to unclasp the fastener, uncoil the cord and pull the magnetic bases apart. This invention may be used daily, as consumers are always transporting/carrying their headphones. This design allows consumers to store their headphones effectively in a compact package, so when a consumer decides to use their headphones again, they do not need to spend time untangling their cords. This cord management design can also be implemented in other devices having a need for a cord management system.

It will be appreciated by one skilled in the art that the means for connecting the two ear pieces can be any well know means of fixing two items together. For example, a plug, threads, Velcro, adhesive, clips, etc. The convex/concave shapes can alternatively be any shape the will allow easy mating of the two bases. Additionally, the cord fastener can be any type of fastener such as a clasp, band, button, snap, Velcro or other material that will allow fixing the cord after it has been coiled about the base.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention. The present invention thus can be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes that come within the meaning and range of equivalency of the claims are to be embraced within their scope.

We claim:

1. An in-ear headphone cord management system comprising:

a first ear piece member having a first side and a second side, the first ear piece member further having a proximal portion with a first electrical cord, and a distal portion having a first earbud on said second side containing said first speaker electrically associated with the second electrical cord to receive an audio signal, the earbud configured for fitting into the outer ear of a listener;

a second ear piece member having a first side and a second side, the second ear piece member further having a proximal portion with a second electrical cord, and a distal portion having a second earbud on said second side containing said second speaker electrically associated with the second electrical cord to receive an audio signal, the earbud configured for fitting into the outer ear of a listener;

wherein the first electrical cord and the second electrical cord converge into a single cord having an audio jack and a cord fastener; and wherein the first side of the first ear piece and the first side of the second ear piece are configured to be detachably conjugated forming a spool for winding cord, the cord secured about the spool with said cord fastener.

2. The in-ear headphone system of claim 1, the first side of the first ear piece member and the second ear piece member are each further comprised of a convex portion and concave portion, wherein when convex and concave portions are configured to be nested when conjugated.

3. The in-ear headphone system of claim 1, where in the front side of the first ear piece member and the front side of the second ear piece member is magnetized to magnetically secure the first ear piece and the second ear piece when conjugated.

4. The in-ear headphone system of claim 1, wherein the cord fastener is selected from a group consisting of a clip, Velcro, button, or buckle.

5. A method of securing an audio cord of in-ear audio headphones, the method comprising the steps of:

providing a first ear piece and a second ear piece, the first ear piece and second ear piece configured to be conjugated to form a spool;

conjugating the first and second ear pieces to form said spool;

wrapping cord around the formed spool;

securing the cord so that it is removably secured about the formed spool.

6. The method of claim 5, wherein the first ear piece and the second ear piece are each comprised of a convex portion and concave portion and the convex portion and the concave portion of the first ear piece and the second ear piece are nested when conjugating to form said spool.

7. The method of claim 5, where in the first ear piece and second ear piece are secured when conjugating by a pair of magnets.

8. The method of claim 5, wherein the cord is secured by fastening with a fastener selected from a group consisting of a clip, Velcro, button, or buckle.

* * * * *